US011136753B2

(12) United States Patent
Johnsen

(10) Patent No.: US 11,136,753 B2
(45) Date of Patent: Oct. 5, 2021

(54) SYSTEM FOR DRAINAGE OF SURFACE WATER

(71) Applicant: Aiwell Holding AS, Vear (NO)

(72) Inventor: Asle Johnsen, Tønsberg (NO)

(73) Assignee: Aiwell Holding AS, Vear (NO)

( * ) Notice: Subject to any disclaimer, the term of this patent is extended or adjusted under 35 U.S.C. 154(b) by 0 days.

(21) Appl. No.: 16/962,259

(22) PCT Filed: May 22, 2019

(86) PCT No.: PCT/NO2019/050115
§ 371 (c)(1),
(2) Date: Jul. 15, 2020

(87) PCT Pub. No.: WO2019/226055
PCT Pub. Date: Nov. 28, 2019

(65) Prior Publication Data

US 2021/0047822 A1 Feb. 18, 2021

(30) Foreign Application Priority Data

May 22, 2018 (NO) ..... 20180711
Oct. 3, 2018 (NO) ..... 20181281

(51) Int. Cl.
*E03F 1/00* (2006.01)
*E03F 5/02* (2006.01)
*E03F 5/10* (2006.01)

(52) U.S. Cl.
CPC ..... *E03F 1/002* (2013.01); *E03F 5/021* (2013.01); *E03F 5/106* (2013.01)

(58) Field of Classification Search
CPC combination set(s) only.
See application file for complete search history.

(56) References Cited

U.S. PATENT DOCUMENTS 2,431,640 A 11/1947 Gordon
4,305,426 A 12/1981 Scheid et al.
4,663,056 A 5/1987 Leech
(Continued)

FOREIGN PATENT DOCUMENTS

AU 772582 B2 4/2004
CH 631774 A5 8/1982
(Continued)

OTHER PUBLICATIONS

International Search Report and Written Opinion dated Aug. 21, 2019 (PCT/NO2019/050115).
(Continued)

*Primary Examiner* — Kyle Armstrong
(74) *Attorney, Agent, or Firm* — Alix, Yale & Ristas, LLP

(57) ABSTRACT

System for drainage of surface water, the system comprises a number of tanks being connected to a main pipeline leading water to a recipient. Each tank has at least one outlet for leading water from the tank to the main pipeline, and a corresponding lid, the lid is limiting the outlet until the water is at a predetermined level in the tank. The system further comprises a check valve arranged downstream of the outlet of each tank, preventing water from entering the tank from the main pipeline, and at least one air bleeder valve and at least one siphonic drainage regulator arranged between a tank and the recipient.

20 Claims, 7 Drawing Sheets

(56) References Cited

U.S. PATENT DOCUMENTS

| | | | | |
|---|---|---|---|---|
| 7,002,481 | B1 * | 2/2006 | Crane | G08B 25/08 324/207.2 |
| 9,290,923 | B1 | 3/2016 | Land et al. | |
| 2005/0180819 | A1 * | 8/2005 | Zook | E03F 11/00 405/43 |
| 2006/0150625 | A1 * | 7/2006 | Behrens | F03B 17/005 60/495 |
| 2009/0077902 | A1 | 3/2009 | Urso | |
| 2009/0255865 | A1 * | 10/2009 | Lee | E02B 8/02 210/170.09 |
| 2010/0000917 | A1 * | 1/2010 | Zook | E02B 13/02 210/119 |
| 2011/0000311 | A1 * | 1/2011 | Petroff | G01F 1/662 73/861.28 |
| 2015/0020886 | A1 * | 1/2015 | Hawley | E03F 5/106 137/1 |
| 2016/0348351 | A1 * | 12/2016 | Johnsen | F16K 31/22 |

FOREIGN PATENT DOCUMENTS

| | | | |
|---|---|---|---|
| DE | 3922481 | A1 | 1/1991 |
| DE | 4228387 | A1 | 3/1994 |
| DE | 10051821 | A1 | 6/2001 |
| NO | 20131476 | A1 | 5/2015 |
| NO | 20141121 | A1 | 3/2016 |
| TW | 200949052 | A | 12/2009 |
| WO | 9923320 | A1 | 5/1999 |
| WO | 20131476 | A1 | 5/2015 |

OTHER PUBLICATIONS

Second Written Opinion dated Apr. 21, 2020 (PCT/NO2019/050115).

Search Report for Norwegian Patent Application No. 20180711 dated Dec. 22, 2018.

Search Report for Norwegian Patent Application No. 20181281 dated Feb. 18, 2019.

* cited by examiner 2
206
204
201
9
205
8

101
103
11

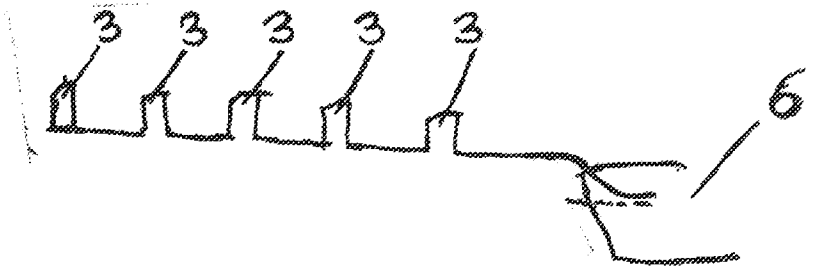
Fig. 5
Fig. 3
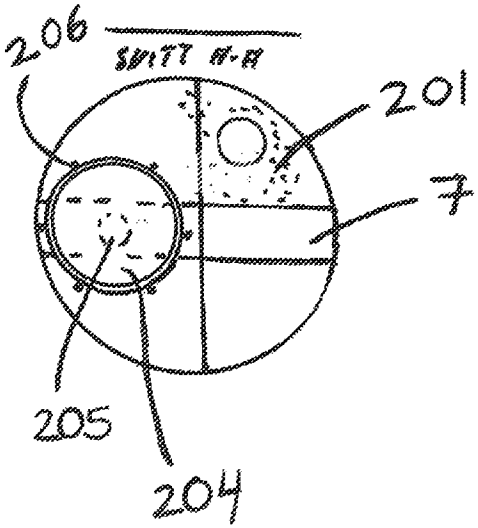

SYSTEM FOR DRAINAGE OF SURFACE WATER

BACKGROUND

The disclosed embodiments relate to a system for drainage of surface water.

Sealed surfaces such as roads, pavements and the like require drainage. It is convenient to connect such drainage with drainage from buildings, as they contain similar type of water and may be handled together. Drainage from roads and buildings are normally requiring less processing than sewage water. Drainage of sealed surfaces, pavements and the like is generally accomplished by open channels, such as channel systems which are covered by gratings.

When the drainage system reaches the limit of drainage capacity during heavy rainfalls, the water is not drained away from the surface, and may cause accidents for instance due to aquaplaning on roads. Another problem is related to backflow of water, as the water may flow back through the pipelines and out of another gutter, creating a flood. This is especially undesirable if drainage from buildings is connected to the same system, as large water damage may occur to the building.

In a traditional drainage system for use in surface water, fluid from inlets is collected and guided in branch pipelines and main pipelines, typically via one or more manholes and/or collection tanks to a recipient, possibly including a water processing plant. The flow is based upon water flowing by its own weight, and is called "gravity flow" or "gravity drainage". Manholes, tanks, pipelines and manifolds are open and allow air to be let into the drainage system and thereby the amount of liquid that the system can handle is limited. In WO 2014/209133 it is described a system whereby the "gravity flow" is replaced by a "full current flow" wherein no gas is flowing together with the water. "Full current flow" is also known as "siphonic drainage" or "siphonic flow".

In order to achieve sufficient drainage during heavy rainfalls, it is also known to use channels wherein the diameter increases in the downstream direction. The installation of these cascade systems is very laborious and costly, as drainage channels with different drainage cross sections have to be combined with one another. This results in higher construction costs and planning costs.

SUMMARY

Provided herein is a surface water drainage system having large drainage capacity, and reducing the risk of back flow and flood. Further there is an object that the system should be reliable and demand little or no maintenance.

The disclosed system may be installed into existing pipelines and manholes, and thus avoid both inconvenience and costs related to construction.

The disclosed drainage system allows both gravity and siphonic drainage, depending on the circumstances, and further that the shift from gravity to siphonic and vice versa should be automatic and fast.

The disclosed drainage system also provides for drainage of water in areas with little or no slope of the pipelines, both the branch pipelines and main pipelines, as long as the recipient is lower than the area to be drained.

The objects are met by a system according to the characterizing part of the independent patent claims. Further advantageous features are stated in the dependent claims.

An embodiment of a system for drainage of surface water according to the disclosure comprises a number of tanks being connected to a main pipeline leading water to a recipient. Each tank has an at least one outlet for leading water from the tank to the main pipeline. The outlet comprises a corresponding lid, wherein the lid is limiting the outlet until the water is at a predetermined level in the tank. A check valve is arranged downstream of the outlet of each tank, preventing water from entering the tank form the main pipeline, and the system comprises further at least one air bleeder valve and an siphonic drainage regulator both arranged between a tank and the recipient.

The tank is preferably a manhole being in open or closed fluid communication to the surrounding environment. By "manhole" it is in this application meant a tank being a part of a drainage system comprising at least one inlet connected to pipelines or drainage systems upstream, and at least one outlet connected to a main pipeline or a branch pipeline downstream. The manhole further comprises a reservoir for water, and usually a reservoir for sand and other sedimentable pollutions. Some manholes also comprise a detachable cover, pumps and other equipment, and a manhole may be large enough for a person to enter and inspect the drainage system. In the following description tank and manhole is used interchangeably, and refers to the same unit.

By "limiting the outlet" it is in this application meant that the lid limits the amount of water that may flow through the outlet. This may be done by limiting the cross section of the outlet, or by limiting an opening to the outlet for instance by lifting the lid a very short distance above the outlet. Limiting should also include the situation wherein the lid closes the outlet completely. In different embodiments, one lid may cover several outlets, and one outlet may have several lids, for instance wherein each lid has different buoyancy, which will open and limit the cross section of the outlet depending on the amount of water in the tank.

The recipient may be the ocean, but any reservoir or even a large pipe or a culvert which is enabled to receive the water, should be considered as recipient.

By "siphonic drainage regulator" it is meant a regulator which prevents all the water in the pipeline to flow out, regardless of whether the water is flowing by gravity drainage or siphonic drainage. The regulator comprises a barrier, retaining a given level of water in the upstream pipeline, and allowing any water above the level to flow past the regulator. The regulator will function even if the pipeline is flat. The height of the barrier will determine the level of water retained in the pipeline, and thereby the amount of water needed to be added, in order to create siphonic drainage from the tank. The amount of water needed to be added will be the same as the amount of air needed to be removed, preferably through an air bleeder valve.

The regulator is preferably an inverted U-shaped pipeline meaning a pipeline having a part turning upwards, in order to create a curvature having the curve at the upper point. Even if the expression U-shaped is used, the vertical parts may be slanting and not vertical. These kinds of bends are well known to a skilled person. The height of the curvature will be the barrier, as the level of water retained in the upstream pipeline will correspond to the inner lower end of the curvature, which is well known to a skilled person. The same function may be achieved with a traditional spillway, where the inlet is arranged lower than the outlet, and the level of the outlet will be determining for the water level remaining in the pipeline upstream of the spillway.

In embodiments where the regulator is an inverted U-shaped pipeline, if the lower part of the curvature of the inverted the U-shaped pipeline is above the outlet of the tank, gravity drainage will not occur, as no gas will enter the outlet, and the pipeline connecting the outlet to the regulator will always be filled. If the lower part of the curvature of the inverted U-shaped pipeline is below the outlet, then only the part of the pipeline being lower than the U-shaped pipeline will be filled with water, and water may flow out of the tank by gravity drainage. In embodiments where the regulator is a spillway, then the same regulation will depend on the level of the outlet of the spillway. In a disclosed embodiment of the system, the levelling and choice of the siphonic drainage regulator may differ throughout the system. In a preferred embodiment, the water regulator is an inverted U-shaped pipeline, wherein at least the lower part of the curvature is arranged below the outlet of the tank.

Siphonic drainage regulators and air bleeder valves may be arranged at the main pipeline, at a branch pipeline, at the outlet of the manhole, or at any other convenient place along system. The air bleeder valve is preferably arranged at the top curvature of the inverted U-shaped pipeline, but it may also be arranged at any other places along the system. An air bleeder valve according to the disclosure, lets air out but not into the system.

In an embodiment wherein the system is air tight and the water is only flowing at siphonic drainage, the use of siphonic drainage regulators along both the main pipeline and any branch pipeline will be very helpful in locating a leakage. When a leakage appears, the pipeline downstream will be emptied, but the pipeline upstream of the nearest siphonic drainage regulator, upstream of the leakage, will not be affected by the leakage. This means, rather than testing every manhole and pipeline of the whole system, only the manholes and pipelines between the last siphonic drainage regulator with full pipeline, and the first siphonic drainage regulator with empty pipeline needs to be tested. It is a further advantage to have a siphonic drainage regulator when a branch pipeline is connected to the main pipeline, as the branch pipeline may not be affected even if there is a leakage in the main pipeline. Leakage may also be surveilled automatically with sensors, reporting directly to a control unit, either directly or wireless.

A check valve is arranged in the system, downstream of the outlet of each tank, preventing water from entering the tank through the outlet. The check valve may be arranged on the pipeline between the tank and the branch pipeline, or on the branch pipeline, independent on the siphonic drainage regulator.

During heavily rainfall, more water will flow from the manhole nearest the recipient, and less water from the farthest manhole, which may create a flood in the farthest manhole, and overcapacity in the nearest manhole. In the disclosed embodiments, this may be solved by having several outlets of each manhole, and by opening the suitable number of outlets in each manhole. In another embodiment, the outlet of the manhole being closest to the recipient has less cross section than the outlet of the manhole next closest to the recipient, and the outlet of the manhole being farthest off the recipient has the largest cross section. In both cases, when the outlet as a whole of the manhole being closest to the recipient has less cross section than the outlet as a whole of the manhole next closest to the recipient, etc., the capacity of the system as a whole is improved. With a system according to the disclosure, wherein each tank has more than one outlet, only the suitable number of outlets in each tank will be opened, and thus more water will be removed in the areas having the most rainfall.

When the water is flowing into the manhole, sand and other pollutants are precipitating at the reservoir for sand, while the water is flowing out through the outlet. When more water is flowing into the manhole than out of the outlet, the water level of the water reservoir in the manhole will rise. The outlet in the manhole has a corresponding lid preferably allowing both gravity drainage and siphonic drainage, depending on the level of water in the reservoir of the manhole, and once the level has reached a predetermined level, the lid will open for siphonic drainage. Such an outlet with lid is well known to a skilled person.

When the outlet opens for siphonic drainage, the amount of the water flowing out of the manhole will also increase. At one point it will fill the pipeline 100%. Normally this occurs at the outlet to the recipient but it can also occur in flat areas of the pipelines. When this happens there will be a pressure in the system and the water will try to get out the easiest way, usually out of the manholes downstream. Check valves may be arranged downstream of the outlets in the manholes, and will prevent this from happening. The increase in pressure will increase the flow speed in the pipeline. At one point, the water will drag all the air in the pipelines out into the recipient. When this happens the flow shifts from gravity to siphonic drainage and the capacity in the pipelines increases depending on the height difference from the start of the system to the end, at the recipient and also on the length of the pipeline. During the shift from gravity drainage to siphonic drainage, in a system according to the disclosure, the pipes remain partly willed with water at all times, and the air will escape from the air bleeder valves arranged along the system, and thus the shift will occur faster.

When the rain stops one of two alternatives will occur in a system according to the disclosure:

1) If the outlet of the main pipeline is under the water in the recipient and the lid closes the outlet of the tank air tight, then the whole pipeline system will be 100% filled with water. This system will maintain siphonic pressure.

2) If the outlet of the main pipeline is not under water, or the lids allow some air to flow into the outlet, then some water will flow out of the system, and be replaced by air, and the system will return to a gravity drainage system. Due to the siphonic drainage regulators, some water will also remain in the pipelines, allowing a fast shift back to siphonic drainage when needed.

In an alternative embodiment, sensors are arranged along the system both in manholes and in pipelines, registering pressure and/or water level. Such sensors may be registering pressure gas moisture sensors, water level etc., and should also include ultrasound sensors. The rate of the water flow, the level of solid particles, such as sand, and the temperature may also be informative to an operator of the system, and thus corresponding sensors may also be added. The sensors may report to a control unit either directly or wireless. In this way, any operator of the system may monitor when a pipeline is flowing with siphonic drainage and with gravity drainage, and use this information for future improvements and/or developments of the system.

When the water level in the manholes increases and the system shifts to siphonic drainage, at least the whole pipeline between the outlet of the manhole and the siphonic drainage regulator will be filled with water, and more water will flow through the system compared to gravity drainage. Depending on the inflow to the manhole, the water level in the manhole may start sinking, but if the inflow is high, the water level in the manhole may rise and the speed of the water leaving the manhole will increase causing more water to flow through the pipelines until it reaches its maximum capacity.

In one embodiment, each manhole is connected to a branch pipeline, and each branch pipeline is connected to a main pipeline, leading the water to a recipient. A number of manholes may be connected to the same branch pipeline.

In a preferred embodiment, a siphonic drainage regulator, such as an inverted U-shaped pipeline as mentioned above, is arranged between the branch pipeline and the main pipeline, and/or between the main pipeline and the recipient. When the lid and the outlet of a tank allows for gravity drainage, the siphonic drainage regulator will ensure that the pipeline from the regulator to the outlet of the tank is at least partly filled with water, regardless of the water level downstream of the regulator.

The regulator may also be arranged between a manhole and the branch or main pipeline.

Each outlet has a lid limiting the amount of water entering the outlet until the water is a predetermined level in the manhole. In one embodiment, the lid is allowing some water to enter the outlet regardless of the water level of the manhole, and this allows gravity drainage. In a more preferred embodiment, the lid is a float, and once the water level is above a predetermined level, the float maybe removed from the outlet of the outlet and siphonic drainage will be allowed. These embodiments may preferably be combined in that the lid allows gravity flow until the water is at a predetermined level in the manhole, then it is removed and allows siphonic drainage.

In an alternative embodiment, the lid will only be lifted a given distance, allowing some water but still limiting the amount of water entering the outlet. In yet another embodiment, the lid has a design that limits the flow of water into the outlet, even after the lid is lifted off the outlet.

In a preferred embodiment, each manhole has a number of outlets, and the number of outlets being opened depends on the level of water in the manhole. In this case more water in the manhole results in more outlets being opened, thereby increasing the total cross section of the outlets, and more water may be drained.

When the whole or part of the system operates at siphonic drainage, there will be a suction in the outlet of the manhole. This suction is proportional to the height difference of the pipeline between the beginning of the siphonic drainage and the manhole. If the whole system is running with siphonic drainage, then the suction will depend on the height difference between the outlet of the manhole and the final destination, recipient, of the water. If only parts of the system are running with siphonic drainage, for instance a branch pipeline, then the suction will depend on the height from the beginning of the branch pipeline to the outlet of the manhole. Parts of the system may be running with siphonic drainage due to the siphonic drainage regulator as described above, or because the outlet of the branch pipeline into the main pipeline is below water. The effect of suction during siphonic drainage is well known to a skilled person.

A system may utilize well known pipelines and manholes, and may thus be installed in already existing drainage systems preferably after the systems are made air tight in order to avoid leakage of air into the system.

The disclosed embodiments also relate to a tank or manhole comprising at least one inlet, at least one outlet and a water reservoir. The outlet comprises a corresponding lid, limiting the outlet until the water in the water reservoir is at a predetermined level.

The tank further comprises a check valve arranged downstream of the outlet, preventing water from entering the tank through the outlet, and a siphonic drainage regulator, preferably having an air bleeder valve, arranged downstream of the outlet. A manhole or tank according to the disclosure may be prefabricated as a whole, or existing tanks and manholes may be amended. By replacing manholes and tanks in an existing drainage system with a tank according to the disclosure, the existing system will be amended to a system according to the disclosure.

if desired, pipelines between the manholes may be processed to be air tight, and then the system may even run as a siphonic drainage system at all times.

EXAMPLES

The following description of an exemplary embodiment refers to the figures, and the following detailed description is not meant or intended to limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily refer ring to the same embodiment. Further, the particular features, structures or characteristics may be combined in any suitable manner in one or more embodiments.

The different parts of the figures are not necessarily in scale to each other, as the figures are merely for illustrating the invention.

BRIEF DESCRIPTION OF THE DRAWINGS

The invention will in the following be described with reference to the enclosed figures, where FIG. 3 shows a section along line A-A of FIG. 2, FIG. 5 shows a system according to the disclosure, comprising a number of manholes.

DETAILED DESCRIPTION

Figure 1:
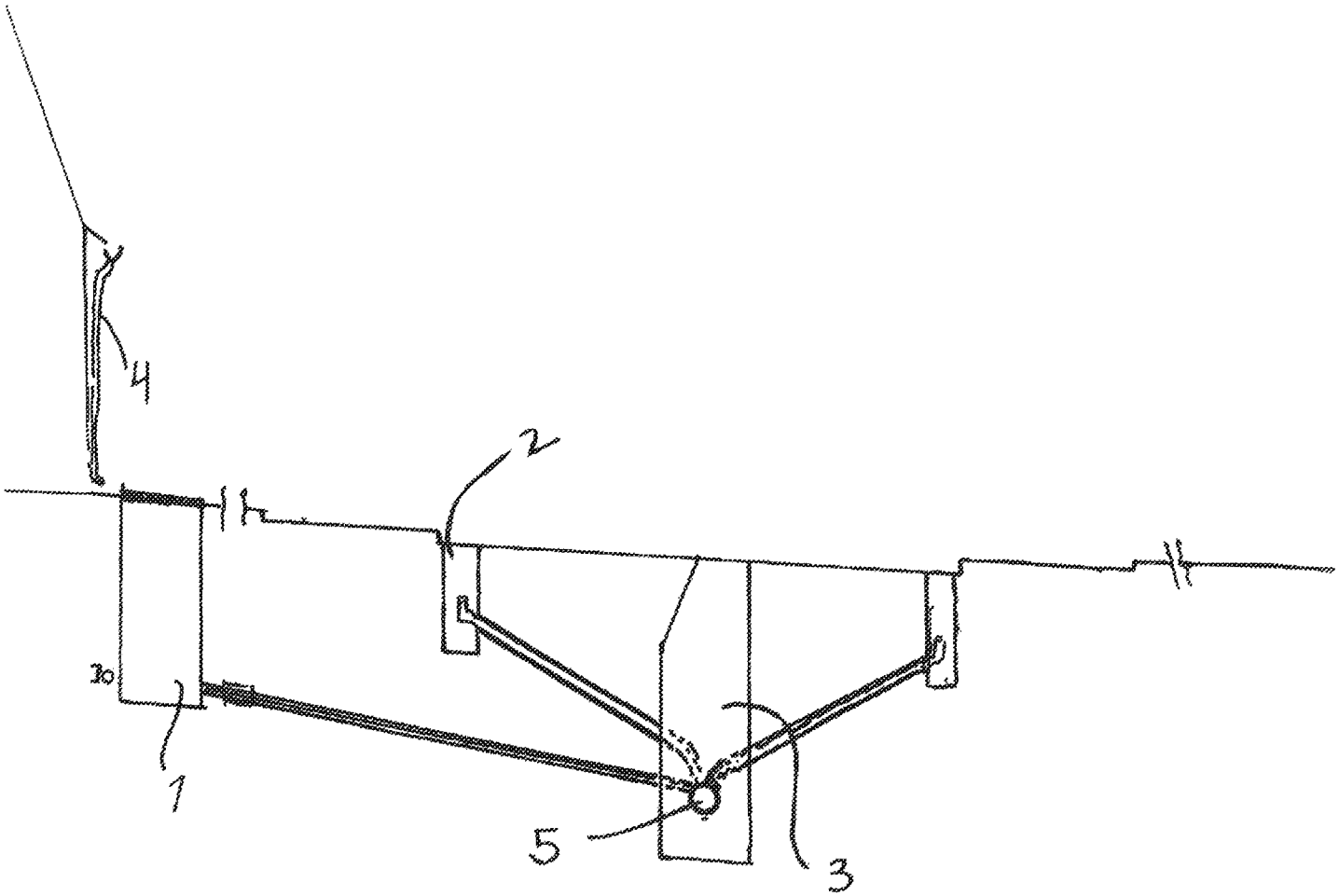
FIG. 1 shows a cross section of a road with a drainage system according to the disclosure.

In the embodiment shown in FIG. 1, a drainage system comprises different types of manholes. One type of manhole 1 for receiving water from a building, preferably from the rain gutter 4 of a building, one type of manhole 2 for receiving water from a road, and one type of manhole 3 receiving water from the other manholes 1, 2, and connected to a main pipeline 5 leading water to a recipient 6.

Figure 2:
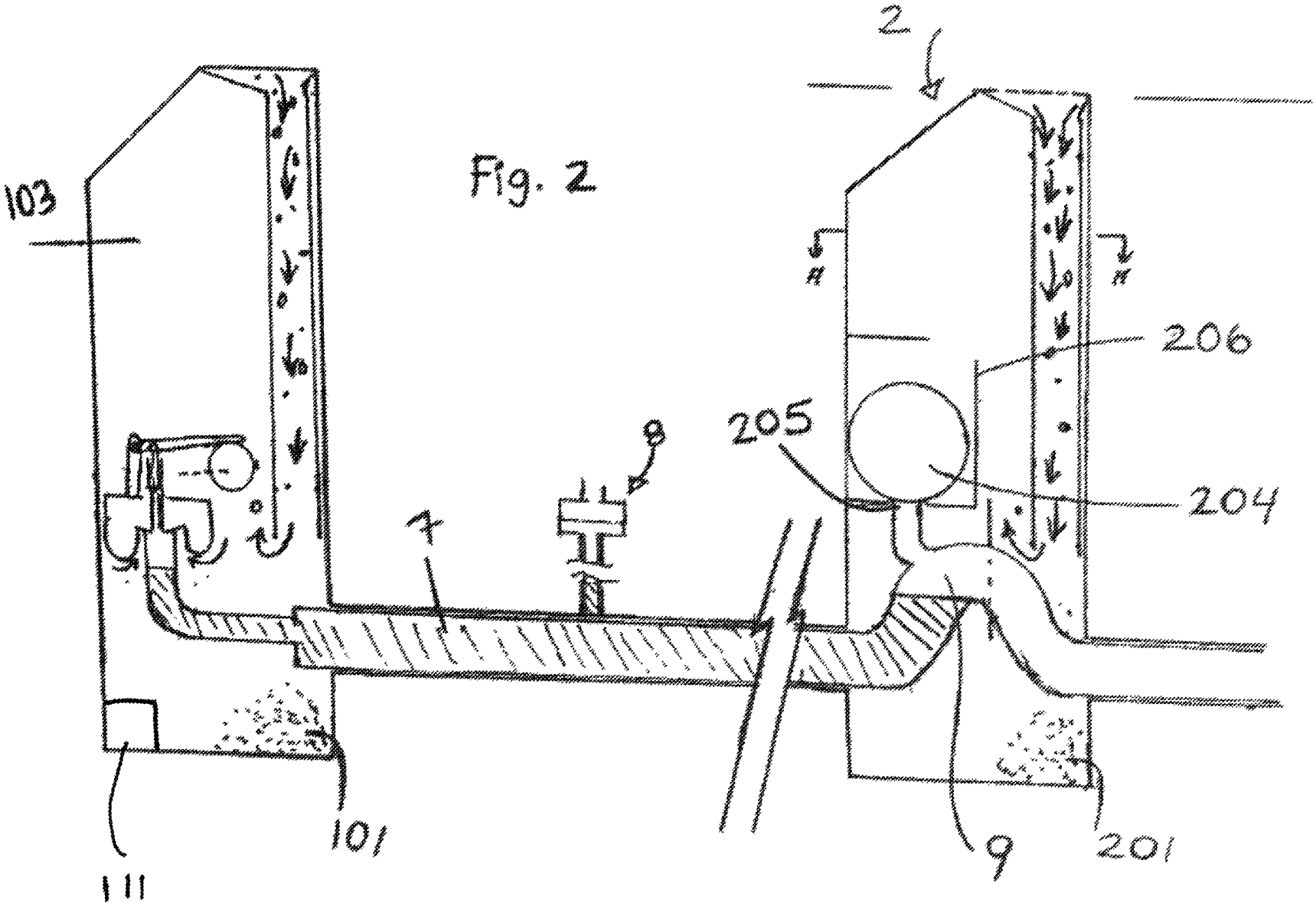
FIG. 2 shows two manholes of a system according to the disclosure.

In FIG. 2, two manholes 1, 2 of a system are shown in detail. Water is entering manhole 1 for instance from a rain gutter 4 of an adjacent building as shown in FIG. 1, and flowing into a sand reservoir 101 at the bottom of the manhole 1. An outlet 105 is arranged at a distance from the bottom of the manhole, and the space 103 inside the manhole is used as a water reservoir. Correspondingly, water is entering the manhole 2 for instance from the road as shown in FIG. 1, flowing into a sand reservoir 201 at the bottom of the manhole, and an outlet 205 is arranged at a distance from the manhole. The outlets 105, 205 of both manholes are connected to a pipeline 7, which is running from manhole 1 and into manhole 2, and further towards a recipient. In the shown embodiment, a part of the pipeline 7 is arranged as an inverted U-shaped pipeline having a vertical curve or bend 9, which allows the pipeline from manhole 1 to the curve 9, to remain filled with water, even if air is drawn into the outlet at manhole 1 and/or 2. The shift from gravity drainage to siphonic drainage from manhole 1 will thus be faster, and in a preferred embodiment an air bleeder (not shown) is arranged at the top of the bend, in order to let air out of the pipeline 7, if necessary.

On the pipeline 7, between the manholes, there is shown a branch pipeline having a check valve 8. The branch pipeline may be leading to another manhole or directly to a building (not shown), and the check valve will be preventing backflow of water from the pipeline 7. Check valves may also be arranged downstream of manhole 1, upstream of the branch pipeline, to prevent backflow into manhole 1, and downstream of manhole 2, which will be obvious to a skilled person.

In manhole 2, the outlet 205 is shown with a lid in the form of a ball 204 arranged on the top of the outlet 205, whereby the ball 204 is surrounded by guiding pins 206.

Sensors 111 may be arranged for registering one or more of pressure, gas, moisture and water level. Sensors are arranged along the system both in manholes and in pipelines, registering pressure and/or water level. Such sensors may register pressure gas moisture sensors, water level etc., and should also include ultrasound sensors. The rate of the water flow, the level of solid particles, such as sand, and the temperature may also be informative to an operator of the system, and thus corresponding sensors may also be included. The sensors may report to a control unit either directly or wireless. In this way, any operator of the system may monitor when a pipeline is flowing with siphonic drainage and with gravity drainage, and use this information for future improvements and/or developments of the system.

This is also shown in FIG. 3 showing a cross section of manhole 2. When the water level in manhole 2 is sufficient to lift the ball 204 off the outlet 205, water will flow into the outlet. Under normal conditions, the outlet will only function with siphonic drainage, as the water will not lift the ball unless the water level is above the opening of the outlet.

In a not shown embodiment, the ball is bearing against knobs or the similar on a top edge of the outlet, leaving a small opening into the outlet even when the ball is resting on the top. With this embodiment, the manhole 2 will also function with gravity drainage.

Figure 4:
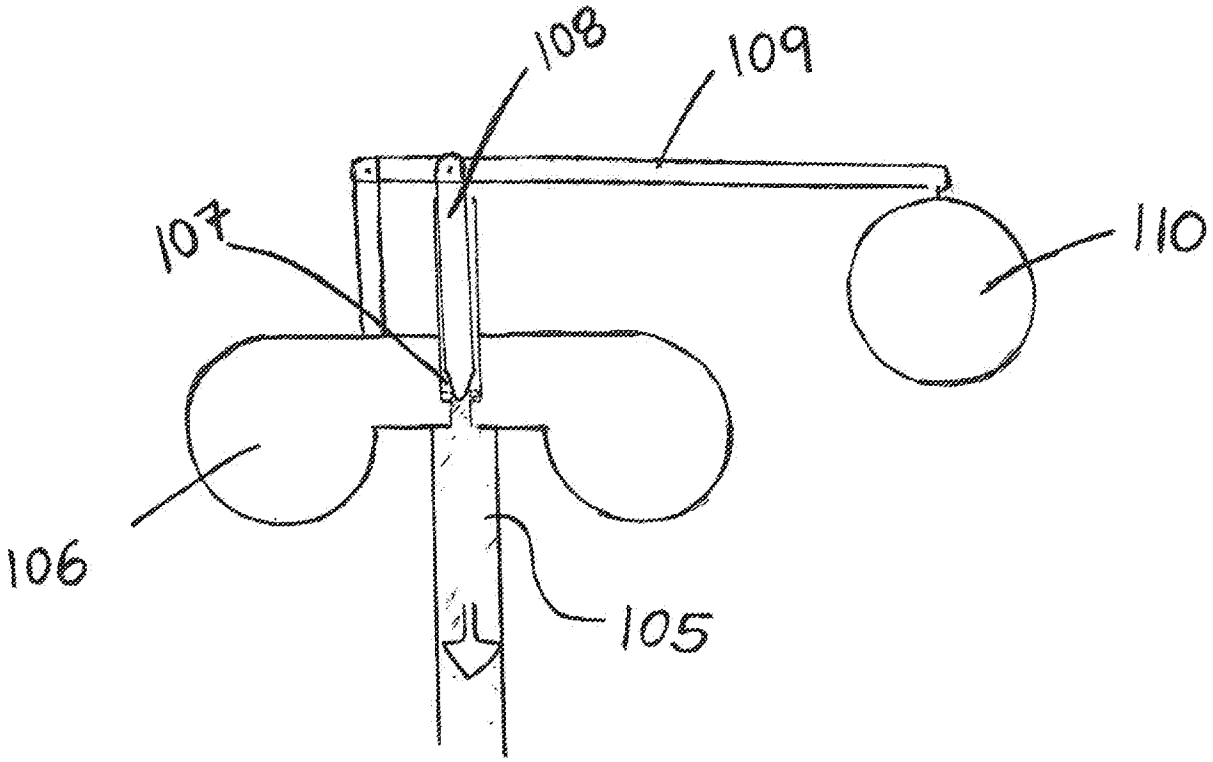
FIG. 4 shows a part of FIG. 2, in detail.

FIG. 4 shows the outlet and lid of manhole 1 in FIG. 2 in detail. The lid is an alternative to the lid in the form of a ball as described above, and covers an outlet 105 of the manhole 1. The lid shown in FIG. 4 comprises a first float 106 having a through opening 107, being closed by a cap 108 arranged on a lever 109 operated by a second float 110. When the second float 110 is lifted by the water in the manhole, the cap 108 is lifted off the opening 107 of the first float 106. Air will then be drawn through the opening 107 and into the outlet 105, reducing negative pressure inside the outlet, and then the first float 106 will be lifted off the outlet 105. By designing the lid in this way, using a second float 110 to let air into the outlet and thereby reducing the negative pressure, the lid shown in FIG. 4 is lifted at a lower water level than if the first float 106 should be lifted directly.

FIG. 5 shows an overview of a number of manholes 3 connected to the same main pipeline leading the water to a recipient 6, leaving the siphonic drainage regulators, check valves etc, out. When all outlets and the main pipeline operates at siphonic drainage, the amount of water flowing through the system and into the recipient is greatly increased compared to when the system operate at gravitational drainage. As shown in FIG. 5, when the outlet of the main pipeline is submerged under water in the recipient 6, the pipelines are air tight, and each manhole is arranged to only open when the water level is above the outlet, the pipelines will be filled with water at all times, and the system as a whole will always operate at siphonic drainage. The same effect will occur by using a siphonic drainage regulator.

Figure 6:
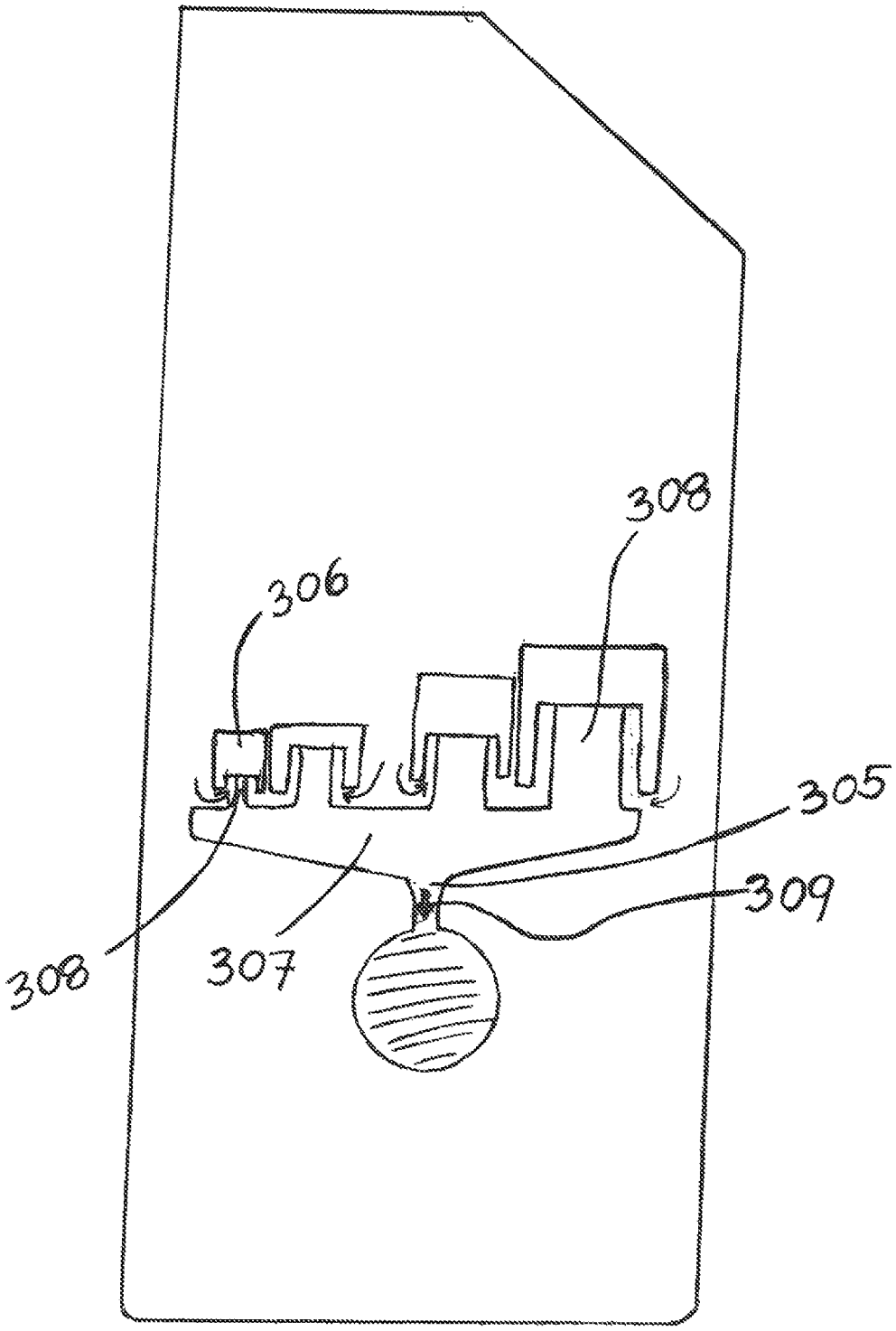
FIG. 6 shows another embodiment of the outlet according to the disclosure.

FIG. 6 shows a cross section of an alternative embodiment of an outlet and corresponding lid, wherein the outlet comprises an inner chamber 307 having one outlet 305 to the main pipeline, four inlets 308 leading water from the manhole to the inner chamber 307, and a check valve 309 arranged in the outlet. Each inlet 308 have different cross section, are arranged at different levels in the manhole, and are covered by a separate lid 306 designed to have different buoyancy. The sum of the cross sections of the inlets 308 to the inner chamber 307 are larger than the cross section of the outlet 305 from the inner chamber to the main pipeline. When sufficient inlets 308 are open, the flow rate through each inlet will be less than the flow rate through the outlet 305, and thus the inlet resistance due to friction will be reduced by this design. As the inlets 308 are arranged at different levels, and the lids 306 have different buoyancy, the inlets 308 will open at different levels of water in the manhole.

Figure 8:
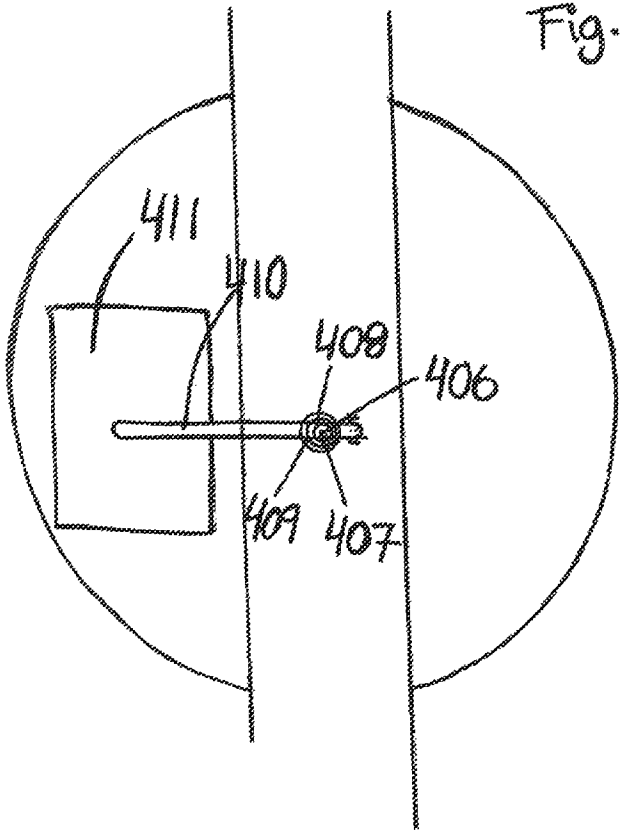
FIG. 8 shows the embodiment of FIG. 7 from above.
Figure 7:
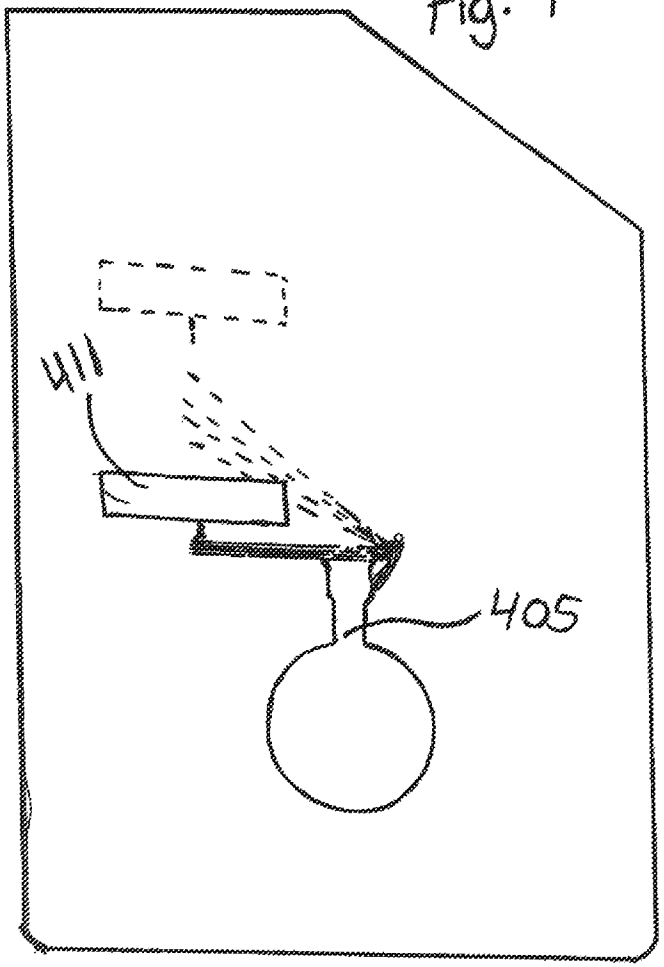
FIG. 7 shows yet another embodiment of the outlet according to the disclosure.

FIGS. 7 and 8 show another alternative embodiment of an outlet and corresponding lid, wherein the lid of the outlet 405 has four sections 406, 407, 408, 409. All sections are connected to a lever 410 having a float 411, wherein the first section 406 will be lifted off the outlet when the float 411 is at a first level, the second section 407 when the float 411 is at a second level, the third section 408 when the float is at a third level, and the fourth section 409 when the float is at the top level. The sections are shown as surrounding rings of a circle, wherein the first section 406 is a circle, and the other sections 407, 408, 409 are rings surrounding the circle 406. As the sections are lifted off, the cross section of the outlet becomes larger. In FIG. 7 the lid is shown when closing the outlet, and the different levels are indicated with dotted lines.

Figure 9:
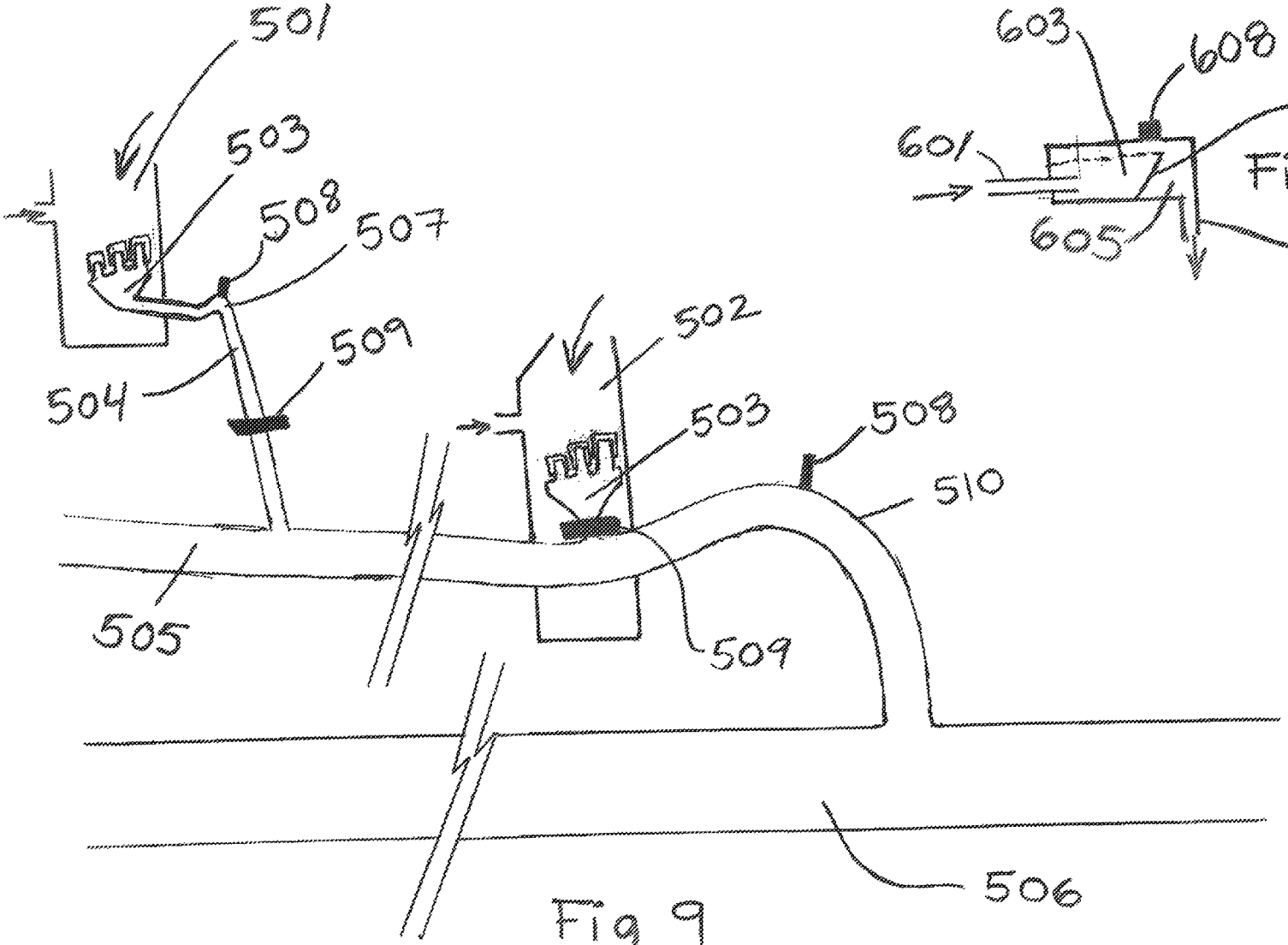
FIG. 9 shows another embodiment of a system according to the disclosure, comprising a number of manholes.

FIG. 9 shows another embodiment of a system, comprising two manholes 501, 502 each having an outlet 503 as shown in detail in FIG. 6. The manholes 501, 502 are connected to a branch pipeline 505, and the branch pipeline is connected to a main pipeline 506. The manhole 501 is connected to the branch pipeline 505 via a pipeline 504, having a siphonic drainage regulator between the outlet of the manhole and the connection to the branch pipeline. The siphonic drainage regulator is shown as an inverted U-shaped pipeline 507, having the whole curve below the outlet of the manhole, and comprising an air bleeding valve 508 at the uppermost part of the curve. The air bleeder valve 508 will let air out of the pipeline 504 when the drainage is shifting from gravity drainage to siphonic drainage. The other manhole 502 is connected directly to the branch pipeline 505. A check valve 509 is arranged between the outlet of the manhole and the connection to the branch pipeline 505 on both manholes 501, 502 in order to prevent that any water from the branch pipeline may flow into the manhole.

In the shown embodiment, a siphonic drainage regulator shown as an inverted U-shaped pipeline, is also arranged between the branch pipeline 505 and the main pipeline 506, having an air bleeder valve 508 arranged at the top of the curve 510.

By having the siphonic drainage regulators arranged in this way, the water may flow out of manhole 501 by siphonic drainage when the pipeline 504 from the curve 507 to the outlet of the manhole 501 is filled with water, regardless of the amount of water in pipeline 505 and 506. Further, water may flow out of both manholes 501 and 502 by siphonic drainage when the pipeline 505 from the curve 510 to the outlet is filled with water, regardless of the amount of water in main pipeline 506. In this way, if large amount of water is entering manhole 501 and/or 502, the shift from gravity drainage to siphonic drainage will be very fast as only parts of the system must be filled with water, and any air in the pipelines may be removed through the air bleeder valves.

If a system according to FIG. 9 is air tight and running with siphonic drainage, the siphonic drainage regulators shown as inverted U-shaped pipelines will assist in identifying where any leakage is. If manhole 502 is leaking, the pipeline 505 and 506 will be emptied, but the pipeline from the curve 507 to manhole 501 will remain filled. When searching for the leakage, a skilled person would thus know that the leakage must be upstream of curve 510, but downstream of curve 507. If a manhole (not shown) on the main pipeline 506, upstream of branch pipeline 505 is leaking, the main pipeline will be emptied, but the branch pipeline will remain filled. When searching for the leakage, a skilled person would thus know that the leakage is not on branch pipeline 505.

Figure 10:
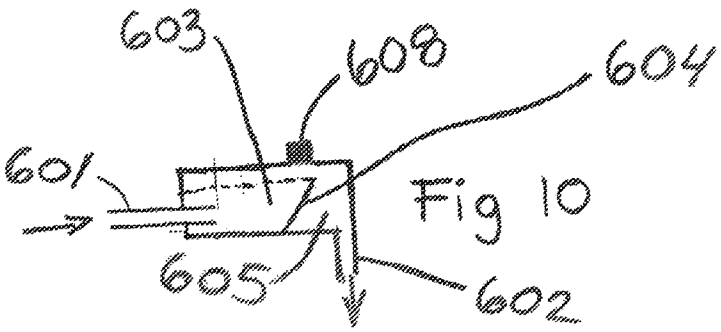
FIG. 10 shows another embodiment of a siphonic drainage regulator.

FIG. 10 shows an alternative embodiment of a siphonic drainage regulator, being an overflow box having an inlet 601, an outlet 602, a water reservoir 603 and a level barrier 604 limiting the water level in the water reservoir. In the shown embodiment, the water level barrier 604 is a wall dividing the box into the water reservoir and an outlet area 605, the wall 604 is shorter than the height of the box, allowing water to flow over the barrier and into the outlet area 605. The height of the barrier will determine the water level of the reservoir. The inlet 601 is arranged in the water reservoir 603, at a level below the water level, and the outlet 602 is arranged at the bottom of the outlet area 605, collecting all water entering the outlet area. The overflow box further comprises an air bleeder valve 608 arranged at the top above the outlet area 605, in order to let air out of the box when the flow of water is shifting from gravity drainage to siphonic drainage, and the box will be filled with water.

Water will enter the inlet and flow into the water reservoir until a given level, whereby it will flow over the level barrier 604 and into the outlet. This principle is well known to skilled persons as a spillway system.

All embodiments of the lid of the outlet shown in FIGS. 3, 4, 6-9 may be arranged on knobs on the top edge of the outlet, and thus the outlet will never be completely closed, allowing gravitation drainage until the water level raises above the opening of the outlet.

The lid according to all embodiments described above and shown in the Figures, may be one or more floats. The necessary buoyancy of the lid will among others depend on the suction of the outlet and the size and number of outlets in one tank, and must thus be calculated when the whole system is designed.

The example above is given to illustrate the invention and should not be used to interpret the following claims limiting. The scope of the invention is not limited by the example given above, but the following claims. Modifications and amendments of the invention, being obvious to a person skilled of the art, should also be included in the scope of the invention.

The invention claimed is:

1. A system for drainage of surface water, the system, comprising:

a plurality of manholes connected to a main pipeline for providing water to a recipient, each manhole having at least one outlet for leading water from the manhole to the main pipeline, the at least one outlet comprising a corresponding lid for limiting the outlet until water is at a predetermined level within the manhole, wherein a check valve is arranged on a pipeline connected to the at least one outlet of the manhole downstream of the outlet of the respective outlet for preventing water from entering the manhole from the main pipeline, the pipeline is arranged as an inverted U-shaped pipeline within a manhole downstream of the outlet, and at least one air bleeder valve is arranged on the inverted U-shaped pipeline, the bleeder valve configured to let air out from the inverted U-shaped pipeline while preventing air from entering into the U-shaped pipeline.

2. The system according to claim 1, comprising a plurality of branch pipelines connected to a main pipeline leading water to the recipient, wherein a plurality of manholes are connected to each branch pipeline, and that an inverted U-shaped pipeline is arranged between the branch pipeline and the main pipeline.

3. The system according to claim 2, wherein the air bleeder valve is arranged at a top of a bend of the inverted U-shaped pipeline.

4. The system according to claim 2, wherein the lid is connected to a float.

5. The system according to claim 2, wherein at least one of the at least one outlet comprises an inner chamber having a plurality of inlets, and the corresponding lids limit the inlets until the water is at different levels in the manhole.

6. The system according to claim 2, further comprising a plurality of sensors for registering one or more of pressure, gas, moisture and water level.

7. The system according to claim 1, wherein the air bleeder valve is arranged at a top of a bend of the inverted U-shaped pipeline.

8. The system according to claim 7, wherein the lid is connected to a float.

9. The system according to claim 7, wherein at least one of the at least one outlet comprises an inner chamber having a plurality of inlets, and the corresponding lids limit the inlets until the water is at different levels in the manhole.

10. The system according to claim 7, further comprising a plurality of sensors for registering one or more of pressure, gas, moisture and water level.

11. The system according to claim 1, wherein the lid is connected to a float.

12. The system according to claim 11, wherein the lid is a float.

13. The system according to claim 12, wherein at least one of the at least one outlet comprises an inner chamber having a plurality of inlets, and the corresponding lids limit the inlets until the water is at different levels in the manhole.

14. The system according to claim 12, further comprising a plurality of sensors for registering one or more of pressure, gas, moisture and water level.

15. The system according to claim 11, wherein at least one of the at least one outlet comprises an inner chamber having a plurality of inlets, and the corresponding lids limit the inlets until the water is at different levels in the manhole.

16. The system according to claim 11, further comprising a plurality of sensors for registering one or more of pressure, gas, moisture and water level.

17. The system according to claim 1, wherein at least one of the at least one outlet comprises an inner chamber having a plurality of inlets, and the corresponding lids limit the inlets until the water is at different levels in the manhole.

18. The system according to claim 1, further comprising a plurality of sensors for registering one or more of pressure, gas, moisture and water level.

19. The system according to claim 18, wherein the sensors are ultrasound sensors.

20. Use of a system for draining surface water, wherein the system comprises:

a plurality of manholes connected to a main pipeline for providing water to a recipient, each manhole having at least one outlet for leading water from the manhole to the main pipeline, the at least one outlet comprising a corresponding lid for limiting the outlet until water is at a predetermined level within the manhole, wherein a check valve is arranged on a pipeline connected to the at least one outlet of the manhole downstream of the outlet of the respective outlet for preventing water from entering the manhole from the main pipeline, the pipeline is arranged as an inverted U-shaped pipeline within a manhole downstream of the outlet, and at least one air bleeder valve is arranged on the inverted U-shaped pipeline, the bleeder valve configured to let air out from the inverted U-shaped pipeline while preventing air from entering into the U-shaped pipeline.

* * * * *